US010590719B2

(12) United States Patent
Gardner et al.

(10) Patent No.: US 10,590,719 B2
(45) Date of Patent: Mar. 17, 2020

(54) MANIFOLD ASSEMBLY FOR A MINERAL EXTRACTION SYSTEM

(71) Applicant: Cameron International Corporation, Houston, TX (US)

(72) Inventors: Laura M. Gardner, Cypress, TX (US); Kathy Hickman, Houston, TX (US); Sundeep Yalamanchi, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 15/440,112

(22) Filed: Feb. 23, 2017

(65) Prior Publication Data

US 2018/0238128 A1 Aug. 23, 2018

(51) Int. Cl.

| | |
|---|---|
| ***E21B 21/01*** | (2006.01) |
| ***E21B 21/06*** | (2006.01) |
| ***E21B 21/10*** | (2006.01) |
| ***E21B 21/00*** | (2006.01) |

(52) U.S. Cl.
CPC ..... *E21B 21/001* (2013.01); *E21B 21/063* (2013.01); *E21B 21/10* (2013.01)

(58) Field of Classification Search
CPC ..... E21B 21/001; E21B 21/063; E21B 21/10
See application file for complete search history.

(56) References Cited

U.S. PATENT DOCUMENTS

| | | | | |
|---|---|---|---|---|
| 7,562,723 | B2 * | 7/2009 | Reitsma | E21B 21/08 175/217 |
| 9,080,407 | B2 * | 7/2015 | Bernard | E21B 21/08 |
| 9,309,732 | B2 | 4/2016 | Boyd | |
| 9,441,429 | B2 * | 9/2016 | Sherwood | E21B 15/00 |
| 9,500,053 | B2 * | 11/2016 | Leuchtenberg | E21B 33/038 |
| 9,506,305 | B2 * | 11/2016 | Leuchtenberg | E21B 21/001 |
| 9,605,502 | B2 * | 3/2017 | Leuchtenberg | E21B 21/08 |
| 2005/0236051 | A1 * | 10/2005 | McBeth | F16K 11/074 137/625.11 |
| 2006/0086538 | A1 * | 4/2006 | Van Riet | E21B 21/106 175/66 |
| 2010/0084142 | A1 * | 4/2010 | Calderoni | A61K 31/385 166/380 |
| 2011/0139464 | A1 * | 6/2011 | Henderson | E21B 21/01 166/370 |
| 2014/0318772 | A1 | 10/2014 | Boyd | |
| 2016/0097270 | A1 * | 4/2016 | Pobedinski | E21B 44/00 700/275 |
| 2017/0044857 | A1 * | 2/2017 | Leuchtenberg | E21B 33/085 |
| 2018/0135366 | A1 * | 5/2018 | Olsen | E21B 44/00 |

FOREIGN PATENT DOCUMENTS

WO 2016176596 A1 11/2016

* cited by examiner

*Primary Examiner* — Matthew R Buck
(74) *Attorney, Agent, or Firm* — Helene Raybaud

(57) ABSTRACT

The disclosed embodiments relate to a system that includes a manifold assembly having a first drilling fluid flow path configured to enable operation of riser gas handling drilling for a mineral extraction system, where the first drilling fluid flow path has an inlet and one or more first outlets, and a second drilling fluid flow path configured to enable operation of a second drilling technique for the mineral extraction system, different from the first drilling technique, where the second drilling fluid flow path has the inlet and one or more second outlets, and where the first drilling fluid flow path and the second drilling fluid flow path are different from one another.

19 Claims, 6 Drawing Sheets

MANIFOLD ASSEMBLY FOR A MINERAL EXTRACTION SYSTEM

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Oil and natural gas have a profound effect on modern economies and societies. In order to meet the demand for such natural resources, numerous companies invest significant amounts of time and money in searching for, accessing, and extracting oil, natural gas, and other subterranean resources. Particularly, once a desired resource is discovered below the surface of the earth, drilling and production systems are often employed to access and extract the resource. These systems can be located onshore or offshore depending on the location of a desired resource. Such systems may include a drilling fluid system configured to circulate drilling fluid into and out of a wellbore to facilitate the drilling process. In some cases, the drilling fluid may be directed to a platform of the drilling system, where the drilling fluid may be filtered and/or otherwise processed before being directed back into the wellbore. Unfortunately, manifolds that receive the drilling fluid include pipes and/or valves that direct the drilling fluid to various locations of the system, and such manifolds may be configured for specific types of drilling. Therefore, multiple manifolds may be included in the drilling system in order to enable the system to perform multiple types of drilling techniques. Such manifolds may be expensive and include a relatively large footprint.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
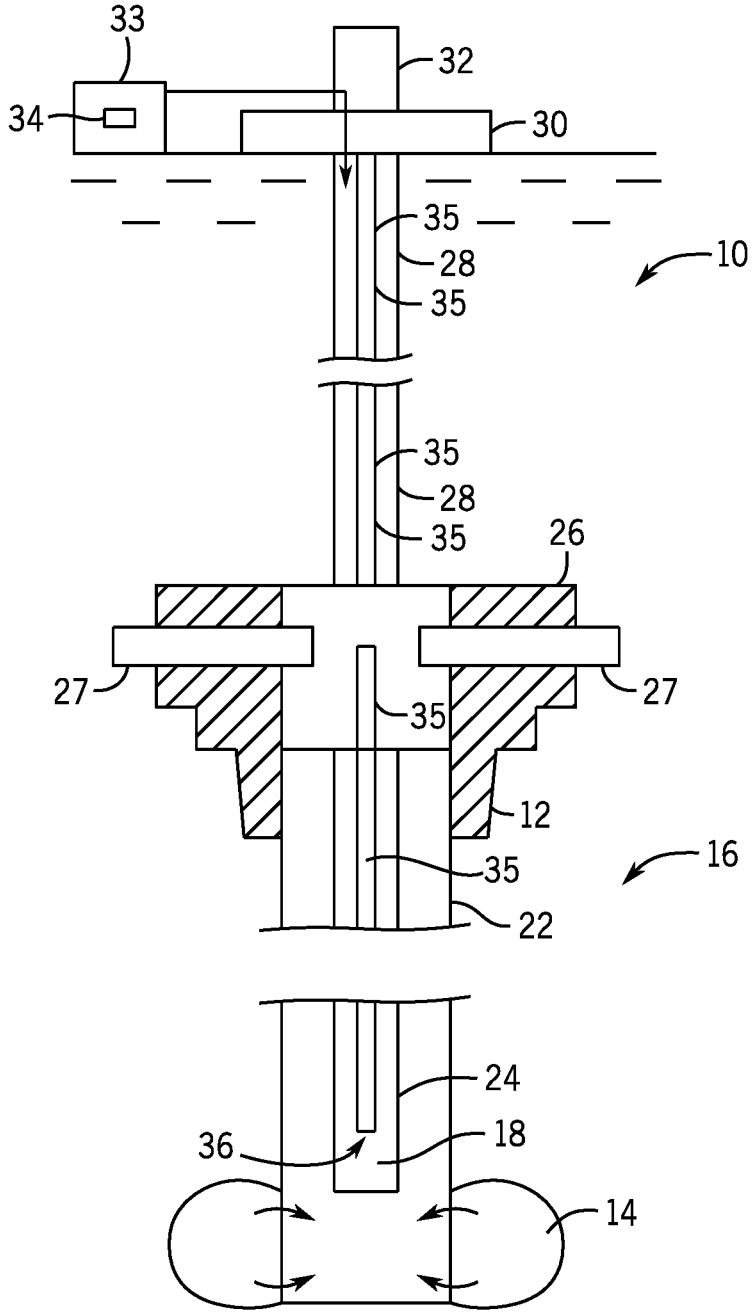
FIG. 1 is a schematic of a mineral extraction system that includes an enhanced manifold assembly, in accordance with an aspect of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Without the present disclosure, mineral extraction systems may include multiple manifolds to enable the system to switch between multiple types of drilling techniques (e.g., managed pressure drilling and riser gas handling drilling). It may be desirable to switch between drilling techniques based on a hardness of a particular layer in which drilling is occurring, an amount of gas (e.g., gas concentration) in a formation, and/or other operating parameters of the mineral extraction system. Unfortunately, each manifold that may be included in the different types of mineral extraction systems includes a relatively large footprint, thereby utilizing a large of amount of relatively limited space available on a rig.

Accordingly, embodiments of the present disclosure relate to a single, enhanced manifold assembly that may enable multiple types of drilling techniques to be performed by the mineral extraction system. Such an enhanced manifold assembly includes a reduced footprint when compared to multiple manifolds, which may create more space on the rig for additional components. Further, the enhanced manifold assembly may reduce costs by enabling a single manifold to be purchased for the system rather than multiple manifolds. Additionally, in some embodiments, the enhanced manifold assembly may include at least a first portion of a drilling fluid flow path that is positioned on a first plane and a second portion of the drilling fluid flow path that is positioned on a second plane, where the first plane and the second plane are crosswise (e.g., substantially perpendicular) to one another. In other embodiments, components of the enhanced manifold assembly may be stacked vertically (e.g., along a vertical axis), such that a first component is at a first vertical height (e.g., with respect to a platform) and a second component is at a second vertical height (e.g., with respect to the platform), different from the first vertical height. Positioning portions of the drilling fluid flow path in such a manner may further reduce a footprint of the enhanced manifold assembly, thereby providing additional space for components.

To help illustrate the manner in which the present embodiments may be used in a system, FIG. 1 is a block diagram that illustrates an embodiment of a mineral extraction system 10. The illustrated mineral extraction system 10 can be configured to extract various minerals and natural resources, including hydrocarbons (e.g., oil and/or natural gas), or configured to inject substances (e.g., drilling fluid, particle laden fluids or frac fluids, chemicals, gases, water, mud, etc.) into the earth. In some embodiments, the mineral extraction system 10 is land-based (e.g., a surface system) or subsea (e.g., a subsea system). As illustrated, the system 10 includes a wellhead assembly 12 coupled to a mineral deposit 14 via a well 16, where the well 16 includes a wellbore 18.

The wellhead assembly 12 typically includes multiple components that control and regulate activities and conditions associated with the well 16. For example, the wellhead assembly 12 generally includes pipes, bodies, valves and seals that enable drilling of the well 16, route produced minerals from the mineral deposit 14, provide for regulating pressure in the well 16, and provide for the injection of drilling fluids into the wellbore 18 (down-hole). For example, FIG. 1 illustrates a conductor 22 (also referred to as "conductor casing") disposed in the well 16 to provide structure for the well 16 and prevent collapse of the sides of the well 16 into the wellbore 18. One or more casings 24, such as surface casing, intermediate casing, etc., may be fully or partially disposed in the bore of the conductor 22. The casing 24 also provides a structure for the well 16 and wellbore 18 and provides for control of fluid and pressure during drilling of the well 16. The wellhead 12 may include, a tubing spool, a casing spool, and a hanger (e.g., a tubing hanger or a casing hanger), to enable installation of casing and/or tubing. The system 10 may include other devices that are coupled to the wellhead 12, such as a blowout preventer (BOP) 26 and devices that are used to assemble and control various components of the wellhead 12.

The BOP 26 may include a variety of valves, fittings and controls to prevent oil, gas, or other fluid from exiting the well in the event of an unintentional release of pressure or an unanticipated overpressure condition. As used herein the term "BOP" may also refer to a "BOP stack" having multiple blowout preventers. The BOP 26 may be hydraulically operated and may close the wellhead assembly 12 or seal off various components of the wellhead assembly 12. During operation of the system 10, a BOP 26 may be installed during removal or installation of additional components, changes in operation of the system 10, or for other reasons. The BOP 26 may be any suitable BOP, such as a ram BOP, an annular BOP, or any combination thereof. The BOP 26 shown in FIG. 1 may be a ram BOP having radially moveable rams 27 configured to close off the bore of the BOP 26 and seal the well 16.

A drilling riser 28 may extend from the BOP 26 to a rig 30, such as a platform or floating vessel. The rig 30 may be positioned above the well 16. The rig 30 may include the components suitable for operation of the mineral extraction system 10, such as pumps, tanks, power equipment, and any other components. The rig 30 may include a derrick 32 to support the drilling riser 28 during running and retrieval, a tension control mechanism, and any other components.

The drilling riser 28 may carry drilling fluid (e.g., "mud") from the rig 30 to the well 16, and may carry the drilling fluid ("returns"), cuttings, or any other substance, from the well 16 to the rig 30. For example, in certain embodiments, the mineral extraction system 10 may include a drilling fluid system 33 that directs the drilling fluid from a source, into the well 16, and back out of the well 16 to a predetermined destination (e.g., a waste container, a reserve pit, or another fluid container). The drilling fluid system 33 may include an enhanced manifold assembly 34 that may enable multiple types of drilling procedures to be performed by the mineral extraction system 10. The drilling riser 28 may also include a drill pipe 35. The drill pipe 35 may be connected centrally over the bore (such as coaxially) of the well 16, and may provide a passage from the rig 30 to the well 16.

FIG. 1 depicts operation of the mineral extraction system 10 during drilling of the well. As shown in FIG. 1, the drill pipe 35 extends from the derrick 32 through the BOP 26, through the drilling riser 28, and into the wellbore 18. The drill pipe 35 may be coupled to a tool, e.g., a drill bit, to aid in drilling the well. For example, in one embodiment the drill pipe 35 may be rotated and/or translated to drill and create the well. Drilling fluid may be directed toward an end 36 of the drill pipe 35 to facilitate movement of the drill pipe 35 and/or the tool (e.g., drill bit) within the well 16. Specifically, the drilling fluid may remove the cuttings and/or other solids from the end 36 of the drill pipe 35 that may block movement of the drill pipe 35 and/or the drill bit. Additionally, the drill pipe 35 may be extended or retracted by adding or removing sections to the drill pipe 35.

Figure 2:
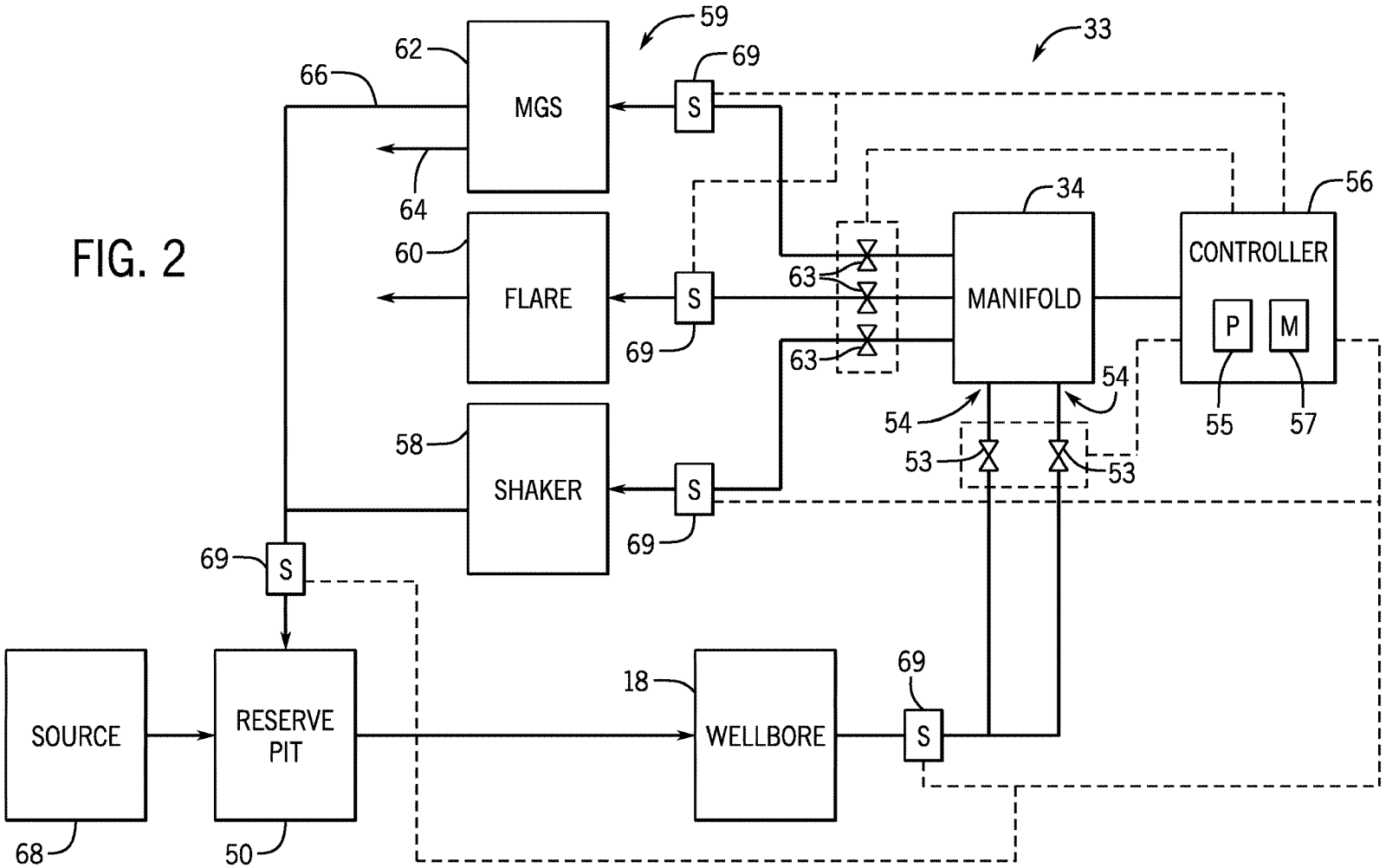
FIG. 2 is a schematic of a drilling fluid system that may include the enhanced manifold assembly of FIG. 1, in accordance with an aspect of the present disclosure.

As discussed above, drilling fluid may be directed into and out of the wellbore 18 through the manifold assembly 34 of the drilling fluid system 33. For example, FIG. 2 is a schematic of the drilling fluid system 33. Drilling fluid may be directed from a fluid container 50 (e.g., a reserve pit) to the wellbore 18. In some embodiments, the drilling fluid may undergo processing (e.g., filtering) between the fluid container 50 and the wellbore 18 to remove relatively large particles and/or other undesirable material from the drilling fluid. In any case, the drilling fluid may eventually flow out of the wellbore 18 and toward the manifold assembly 34 of the drilling fluid system 33.

The manifold assembly 34 may receive the drilling fluid through one or more inlets 54 (e.g., valves driven by actuators). As shown in the illustrated embodiment, a pressure and/or flow rate of the drilling fluid entering the manifold assembly 34 through the one or more inlets 54 may be controlled by one or more inlet valves 53. In some embodiments, the manifold assembly 34 may be coupled to a controller 56 (e.g., electronic controller having a processor 55 and memory 57) that may be configured to control the inlets 54 (e.g., the one or more inlet valves 53) of the manifold assembly 34, and thus, a predetermined flow path that the drilling fluid takes through the manifold assembly 34. For example, the flow path of the drilling fluid through the manifold assembly 34 may be indicative of the drilling technique that is used by the mineral extraction system 10. The manifold assembly 34 may have at least a first drilling fluid flow path (see, e.g., FIG. 3) and a second drilling fluid flow path (see, e.g., FIG. 4). In some embodiments, the manifold assembly 34 may be configured to direct the drilling fluid along one, two, three, four, five, six, seven, eight, nine, ten, or more flow paths.

The manifold assembly 34 may then direct the drilling fluid to one or more downstream components 59 that may be configured to process (e.g., filter and/or clean) the drilling fluid and/or dispose of the drilling fluid. For example, the downstream components 59 may include a shaker 58 (e.g., a perforated or mesh plate that may undergo vibrations to remove large particles from the drilling fluid), a flare 60, and/or a mud gas separator 62, among others. As shown in the illustrated embodiment of FIG. 2, a pressure and/or a flow rate of the drilling fluid exiting the manifold assembly 34 may be controlled by one or more outlet valves 63. The one or more outlet valves 63 may be coupled to the controller 56, which may be configured to adjust a position of the one or more outlet valves 63 to adjust the pressure and/or the flow rate toward the shaker 58, the flare 60, and/or the mud gas separator 62.

In some embodiments, the shaker 58 may be configured to vibrate the drilling fluid to remove relatively large particles from the drilling fluid. Removal of the relatively large particles of the drilling fluid may substantially prevent blockage and/or restrictions within the wellbore 18. As such, the drilling fluid that exits the shaker 58 may be recycled back to the fluid container 50 and ultimately directed back into the wellbore 18.

When the drilling fluid is in the wellbore 18, the drilling fluid may collect minerals (e.g., hydrocarbons) that are present in the wellbore 18. In some embodiments, a portion of the drilling fluid may be directed to the flare 60. The flare 60 (e.g., a combustion chamber, a flare outlet, an ignition system) may be configured to receive the drilling fluid and combust any hydrocarbons and/or minerals that may be present in the drilling fluid. Additionally, the mud gas separator 62 (e.g., a flash chamber and/or another chamber that may enable gas to separate from the drilling fluid) may be configured to separate the minerals (e.g., hydrocarbons) 64 from the drilling fluid 66. In some embodiments, the drilling fluid 66 exiting the mud gas separator 62 may be directed back to the fluid container 50. Additionally, the minerals 64 may be directed to a supplier and/or to another suitable component of the mineral extraction system (e.g., the flare 60).

In any case, the fluid container 50 may receive recycled drilling fluid from the downstream components 59. Additionally, the fluid container 50 may also receive fresh drilling fluid from a source 68 because an amount of drilling fluid returned to the fluid container 50 from the wellbore 18 may be less than an amount originally supplied to the wellbore 18. Accordingly, the source 68 may replenish any drilling fluid that may be lost during the drilling process.

As discussed above, the manifold assembly 34 may be configured to enable the mineral extraction system 10 to operate using multiple drilling techniques. In accordance with embodiments of the present disclosure, the manifold assembly 34 may be configured to enable both managed pressure drilling ("MPD") and riser gas handling drilling ("RGH").

As used herein, MPD may refer to drilling operations that may be utilized when drilling through a sea floor made of relatively soft materials (i.e., materials other than hard rock). MPD may regulate the pressure and flow of drilling fluid through an inner drill string to ensure that the drilling fluid flow into the wellbore 18 does not over pressurize the wellbore 18 (i.e., expand the wellbore 18) or allow the wellbore 18 to collapse under its own weight. The ability to manage the drilling fluid pressure therefore enables drilling of mineral reservoirs in locations with softer sea beds.

Additionally, RGH may refer to drilling techniques that may be configured for formations that include relatively large amounts of gas (e.g., concentrations of gas that exceed 10%, 25%, or 50%) that may ultimately make its way out of the wellbore 18 in the drilling fluid. Accordingly, the RGH drilling technique may be configured to account for an increased concentration of gas within the drilling fluid. In some cases, it may be desirable to remove the gas from the drilling fluid when the drilling fluid includes a large concentration of gas. Therefore, the RGH drilling technique may redirect the drilling fluid to a system and/or component that may reduce the concentration of gas in the drilling fluid (e.g., to concentrations below 10%, 5%, or 2%). The gas concentration in the drilling fluid may ultimately be reduced to a sufficient level, such that the drilling fluid may be directed back into fluid container 50.

However, it may be beneficial for a mineral extraction system 10 to switch (e.g., via the controller 56) between drilling techniques such as MPD and RGH based on an amount of gas within the formation, a hardness of a particular layer in which drilling is occurring, and/or another operating parameter of the mineral extraction system 10 (e.g., pressure, temperature, formation type, mineral type, drilling fluid type, etc.). As a non-limiting example, a formation may include multiple layers, which may include different materials that include different hardness levels and amounts (e.g., concentrations) of gas. Accordingly, it may be desirable to switch from RGH to MPD when entering a layer of the formation that is relatively soft (and has relatively little gas) to adjust the pressure of the drilling fluid and ensure that the drilling fluid does not crack the formation and/or allow drilling fluid to leak into the formation. Similarly, when entering a layer of the formation that is relatively hard and includes a large amount of gas (e.g., a high concentration of gas), it may be beneficial to switch from MPD to RGH to account for the increase in gas.

In some embodiments, the controller 56 may control the manifold assembly 34 (e.g., the valves 53 and/or 63) to switch between MPD and RGH. The controller 56 may be coupled to one or more sensors 69 which may provide the controller 56 with feedback related to characteristics of the drilling fluid. In some cases (e.g., during MPD drilling), the controller 56 may adjust the valves 53 and 63 and/or other components of the manifold assembly 34 to control a pressure in the well 16 based on the feedback from the sensors 69. As a non-limiting example, the one or more sensors 69 may provide feedback to the controller 56 related to the drilling fluid and/or other operating parameters of the mineral extraction system 10. In some embodiments, the feedback may determine a drilling technique that may be performed, such that the controller 56 switches between a first drilling technique and a second drilling technique based on the feedback received from the one or more sensors 69.

As discussed above, certain mineral extraction systems include multiple manifolds that are used to enable switching between drilling techniques (e.g., MPD and RGH). However, each of the multiple manifolds includes a relatively large footprint, thereby utilizing space on the rig 30 that is relatively limited. Accordingly, embodiments of the present disclosure relate to a single, enhanced manifold assembly 34 that may enable multiple types of drilling techniques to be performed by the mineral extraction system 10. Such an enhanced manifold assembly 34 includes a reduced footprint when compared to multiple manifolds, which creates more space on the rig 30 for additional components. Additionally, the enhanced manifold assembly 34 may reduce costs of the system 10 by enabling a single manifold to be purchased rather than multiple manifolds.

Figure 3:
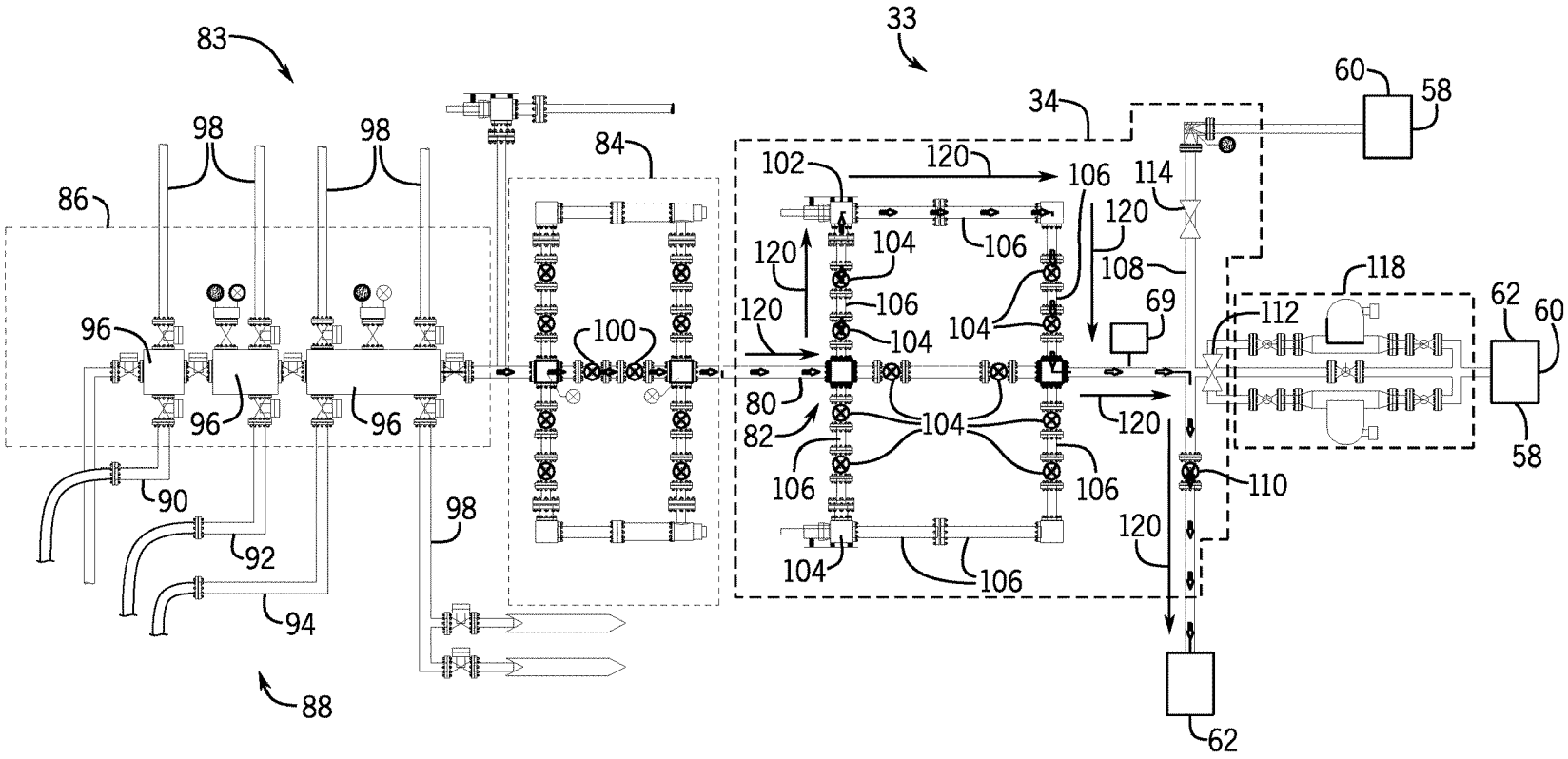
FIG. 3 is schematic of a first drilling fluid flow path through the enhanced manifold assembly that enables the mineral extraction system to perform a first drilling technique, in accordance with an aspect of the present disclosure.

FIG. 3 is a schematic of an embodiment of the manifold assembly 34 when the mineral extraction system 10 operates using the RGH drilling technique. As shown in the illustrated embodiment of FIG. 3, the manifold assembly 34 may receive a flow of fluid 80 through an inlet 82. The inlet 82 may be coupled to the wellbore 18, and in some embodiments, the inlet 82 may be coupled to one or more upstream components 83 that are configured to receive and/or process the drilling fluid exiting the wellbore 18. For example, the inlet 82 may be fluidly coupled to a filter component 84 (e.g., a junk catcher) and/or a distribution manifold 86.

The distribution manifold 86 may receive the drilling fluid from the wellbore 18 via one or more inlet lines 88. In some embodiments, the distribution manifold 86 may receive drilling fluid from a bleed line 90, a primary flow line 92, and/or a secondary flow line 94. As used herein, the bleed line 90 may include a conduit that enables drilling fluid to flow from the wellbore 18 (e.g., in the riser 28) to the distribution manifold 86 when a pressure in the wellbore 18 exceeds a threshold (e.g., pressure relief in the wellbore 18 is desired). Additionally, the primary flow line 92 may include a conduit in which the drilling fluid typically flows from the wellbore 18 to the distribution manifold 86 (e.g., during MPD operation). The secondary flow line 94 may receive excess drilling fluid (e.g., a flow of drilling fluid above a threshold volumetric flow) that may not be directed to the distribution manifold 86 by the primary flow line 92. Utilizing each of the inlets 88 may enable more accurate control over pressure in the wellbore 18 by providing additional lines through which the drilling fluid may flow from the wellbore 18 to the rig 30.

The distribution manifold 86 may include one or more flow control devices 96 (e.g., valves and/or flow meters) that may control an amount of the drilling fluid that flows from the distribution manifold 86 to the filter component 84. The flow control devices 96 may also determine a flow path of the drilling fluid received by the distribution manifold 86. For example, in some cases, it may be desirable to direct the drilling fluid to bypass the filter component and/or the manifold assembly 34. Accordingly, the distribution manifold 86 may include one or more outlet lines 98 that may be configured to direct the drilling fluid away from the filter component 84 and/or the manifold assembly 34 and toward another component (e.g., the fluid container 50 and/or a waste system).

In some embodiments, the distribution manifold 86 may be configured to direct the drilling fluid (e.g., at a controlled flow rate) to the filter component 84 during RGH and/or MPD operations. The filter component 84 may include a junk catcher and/or another similar filter that collects undesired materials from the drilling fluid. For example, in some embodiments, the filter component 84 may remove large particles of formation (e.g., cuttings) collected by the drilling fluid when flowing through the wellbore 18. Additionally, the filter component 84 may remove and/or reduce a concentration of other undesired materials such as chemicals (e.g., injected into the wellbore 18 during the drilling process), hydrocarbons collected in the drilling fluid as it flows through the wellbore 18, and/or other foreign substances that may reduce an effectiveness of the drilling fluid.

As shown in the illustrated embodiment of FIG. 3, the filter component 84 may include one or more filters 100 that may remove the undesired materials from the drilling fluid. For example, the filters 100 may include mesh screens, perforated barriers, membranes, and/or any other suitable type of filter configured to catch the undesired materials and/or restrict a flow of the undesired materials in the drilling fluid from flowing toward the manifold assembly 34.

The drilling fluid may ultimately enter the manifold assembly 34 through the inlet 82. In some embodiments, the manifold assembly 34 may include a choke valve 102 (e.g., an adjustable plug disposed in a conduit that may choke a flow of the drilling fluid from the well 16 to the manifold assembly 34) that may reduce a pressure of the drilling fluid entering the manifold assembly 34. As shown in the illustrated embodiment of FIG. 3, the manifold assembly 34 may further include a plurality of valves 104 disposed along one or more conduits 106 of the manifold assembly 34. In some embodiments, the plurality of valves 104 may include gate valves, ball valves, needle valves, manual wheel valves, electronically actuated valves, and/or another suitable valve. While the illustrated embodiment of FIG. 3 shows the manifold assembly 34 having ten of the valves 104, it should be noted that in other embodiments, the manifold assembly 34 may have less than ten of the valves 104 or more than ten of the valves 104.

In any case, the choke valve 102 may be fluidly coupled to a common manifold 108 of the manifold assembly 34 (e.g., a one-piece manifold and/or a unitary manifold body that is common to multiple flow paths through the manifold assembly 34) that may distribute the drilling fluid to one or more destinations. For example, the common manifold 108 may include a first valve 110, a second valve 112, and/or a third valve 114. While the illustrated embodiment of FIG. 3 shows the common manifold 108 having three valves, it should be noted that in other embodiments, the common manifold 108 may include less than three valves (e.g., two or one valve) or more than three valves (e.g., four, five, six, seven, eight, nine, ten, or more valves). Each of the valves 110, 112, and/or 114 may direct the drilling fluid to a different component and/or destination of the mineral extraction system 10. Accordingly, a position of each of the valves 110, 112, and/or 114 may be adjusted in order to control which of the components and/or destinations that the drilling fluid flows.

For example, the first valve 110 may be coupled to the mud gas separator 62 where the drilling fluid may be separated from minerals (e.g., hydrocarbons) collected when the drilling fluid flowed within the wellbore 18. An operator and/or the controller 56 may open the first valve 110 in situations where the drilling fluid has a high concentration of gases (e.g., as determined by one of the sensors 69 and/or another suitable device). Additionally, the second valve 112 may direct the drilling fluid to a flow meter 118 (e.g., ultrasonic flow meters, fixed or variable orifices, venturies, rotameters, pitot tubes, thermal flow meters, coriolis flow meters, or other suitable flow meters), which may ultimately be coupled to the mud gas separator 62, the flare 60, and/or the shaker 58. As shown in the illustrated embodiment of FIG. 3, the second valve 112 may be closed when the mineral extraction system 10 operates using the RGH technique (e.g., drilling fluid does not flow through the second valve 112). The flow meter 118 may provide relatively fine control over the flow of the drilling fluid flowing toward the mud gas separator 62, the flare 60, and/or the shaker 58, which may not be desired when operating using the RGH technique.

Additionally, the third valve 114 may be coupled to the flare 60, the shaker 58, and/or another component that may be utilized to process, filter, and/or otherwise direct the drilling fluid back to the fluid container 50. It may be desirable to direct the drilling fluid to the flare 60 when the drilling fluid becomes saturated with flammable minerals (e.g., hydrocarbons), such that separation of the drilling fluid in the mud gas separator 62 may not be successful. Additionally, the drilling fluid may be directed to the shaker 58 when the drilling fluid collects large particles as the drilling fluid flows through the wellbore 18.

As shown in the illustrated embodiment, the first valve 110 is open when the mineral extraction system 10 operates using the RGH technique. Accordingly, the drilling fluid follows a first flow path, represented by arrows 120, when the mineral extraction system 10 operates using the RGH drilling technique. However, in other embodiments, another suitable combination of the valves 110, 112, and/or 114 may be in the open position. In some embodiments, the valves 110, 112, and/or 114 may be ball valves, butterfly valves, gate valves, globe valves, diaphragm valves, needle valves, another suitable valve, and/or a combination thereof.

Figure 4:
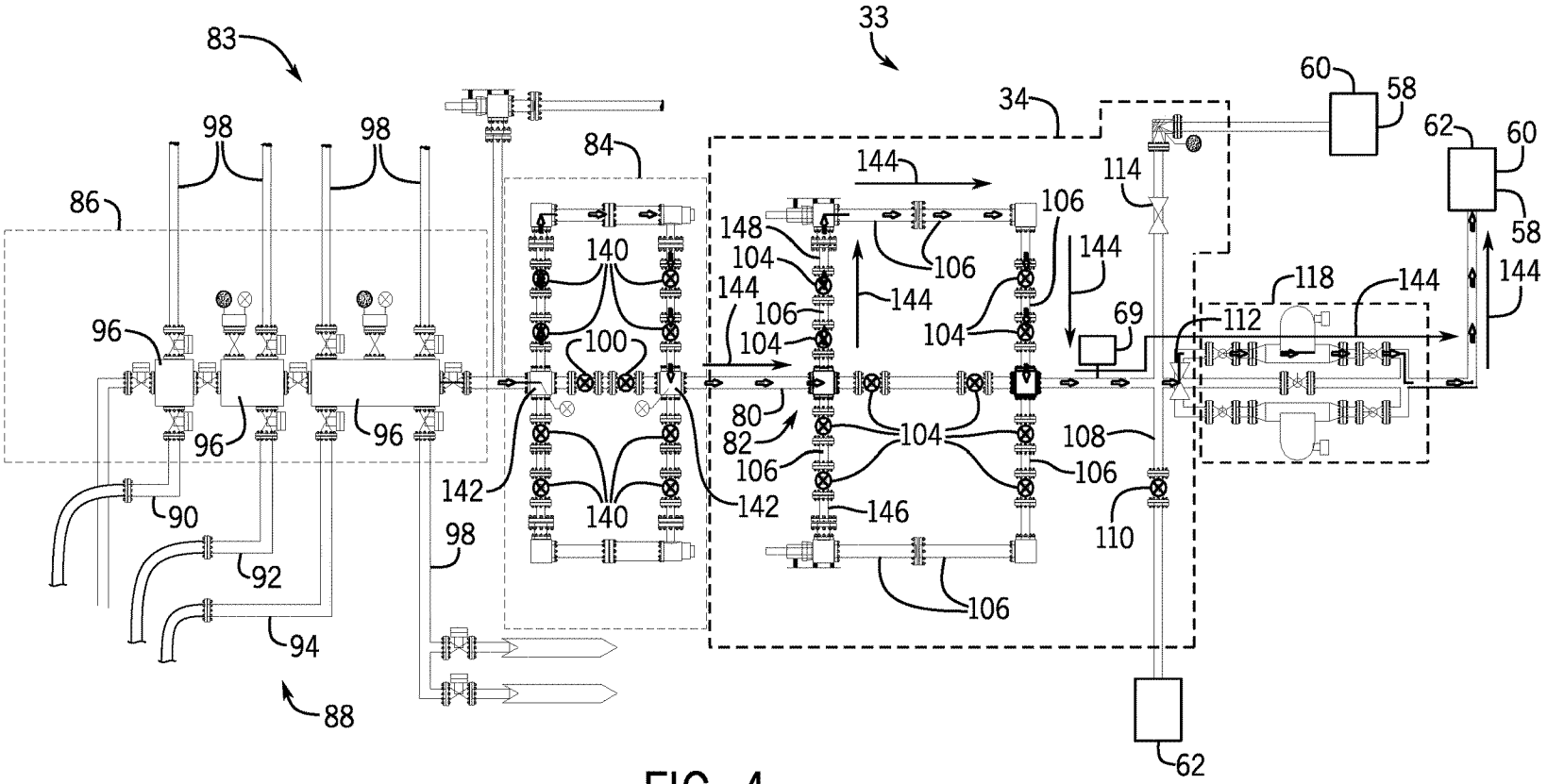
FIG. 4 is schematic of a second drilling fluid flow path through the enhanced manifold assembly that enables the mineral extraction system to perform a second drilling technique, in accordance with an aspect of the present disclosure.

FIG. 4 is a schematic of an embodiment of the manifold assembly 34 when the mineral extraction system 10 operates using the MPD technique. As shown in the illustrated embodiment of FIG. 4, the drilling fluid may be directed into the manifold assembly 34 via the inlet 82 of the manifold assembly 34. In other embodiments, drilling fluid may be directed into the manifold assembly 34 via a second inlet when the system 10 operates using the MPD technique. Additionally, the drilling fluid may be directed to the manifold assembly 34 after flowing through the distribution manifold 86 and/or the filter component 84.

As shown in the illustrated embodiment of FIG. 4, the drilling fluid may be directed through second filters 140 of the filter component 84, such that the drilling fluid bypasses the filters 100 and flows through the filter component 84 along a different path when compared to RGH drilling. In some embodiments, the filter component 84 may include one or more valves 142 that may be coupled to the controller 56 and configured to control which flow path the drilling fluid follows through the filter component 84. Accordingly, the filter component 84 may include different types of filters 100 and/or 142 that are predetermined based on the type of drilling in which the mineral extraction system 10 is performing (e.g., MPD and/or RGH).

For example, when operating using the RGH drilling technique, the filters 100 may be configured to remove gas from the drilling fluid because the drilling fluid may include a higher concentration of gas when compared to drilling fluid that is used when the mineral extraction system 10 performs other drilling techniques (e.g., MPD). In some embodiments, the filters 100 of the filter component 84 used when the system 10 operates using the RGH drilling technique may be membrane filters configured to remove gas particles from the drilling fluid flowing through the membranes. Further, the filters 142 used when the system 10 operates using the MPD technique may be configured to remove relatively small, solid particles because the MPD technique may be utilized when a formation is relatively soft. Accordingly, particles of the formation collected when operating using the MPD technique may be relatively small. Therefore, in some embodiments, the filters 142 may include mesh screens with relatively small openings that enable fluid to pass, but not particles above a target size.

A second drilling fluid flow path may be utilized when operating using the MPD technique, as represented by arrows 144. In some embodiments, the inlet 82 may be fluidly coupled to the choke valve 102. In other embodiments, the drilling fluid may be configured to bypass the choke valve 102 when the system 10 operates using the MPD technique. The drilling fluid may ultimately flow through the manifold assembly 34 toward the second valve 112, which is included in the common manifold 108. Accordingly, the drilling fluid may be directed into the common manifold 108 when the mineral extraction system 10 operates using both the MPD and RGH techniques. Thus, the common manifold 108 includes each of the outlets of the manifold assembly 34 that directs the drilling fluid to downstream components regardless of which drilling technique is being employed. As discussed above, the second valve 112 may be fluidly coupled to the flow meter 118 (e.g., ultrasonic flow meters, fixed or variable orifices, venturies, rotameters, pitot tubes, thermal flow meters, coriolis flow meters, or other suitable flow meters), which may finely adjust a flow rate of the drilling fluid toward the mud gas separator 62 and/or the shaker 58.

As shown in the illustrated embodiment, the drilling fluid is directed from the choke valve 102 through one of the conduits 106 toward the second valve 112. However, in other embodiments, the drilling fluid may be directed through any of the conduits 106 by opening and closing one or more of the valves 104. For example, a first conduit 146 may be utilized when material builds up in a second conduit 148, such that a flow of the drilling fluid through the second conduit 148 is reduced. Accordingly, the drilling fluid may bypass the second conduit 148 and still flow to the second valve 112 through the first conduit 146. When the drilling fluid flows through the first conduit 146, an operator may remove the material blocking the second conduit 148 without shutting down operation of the mineral extraction system 10.

Figure 5:
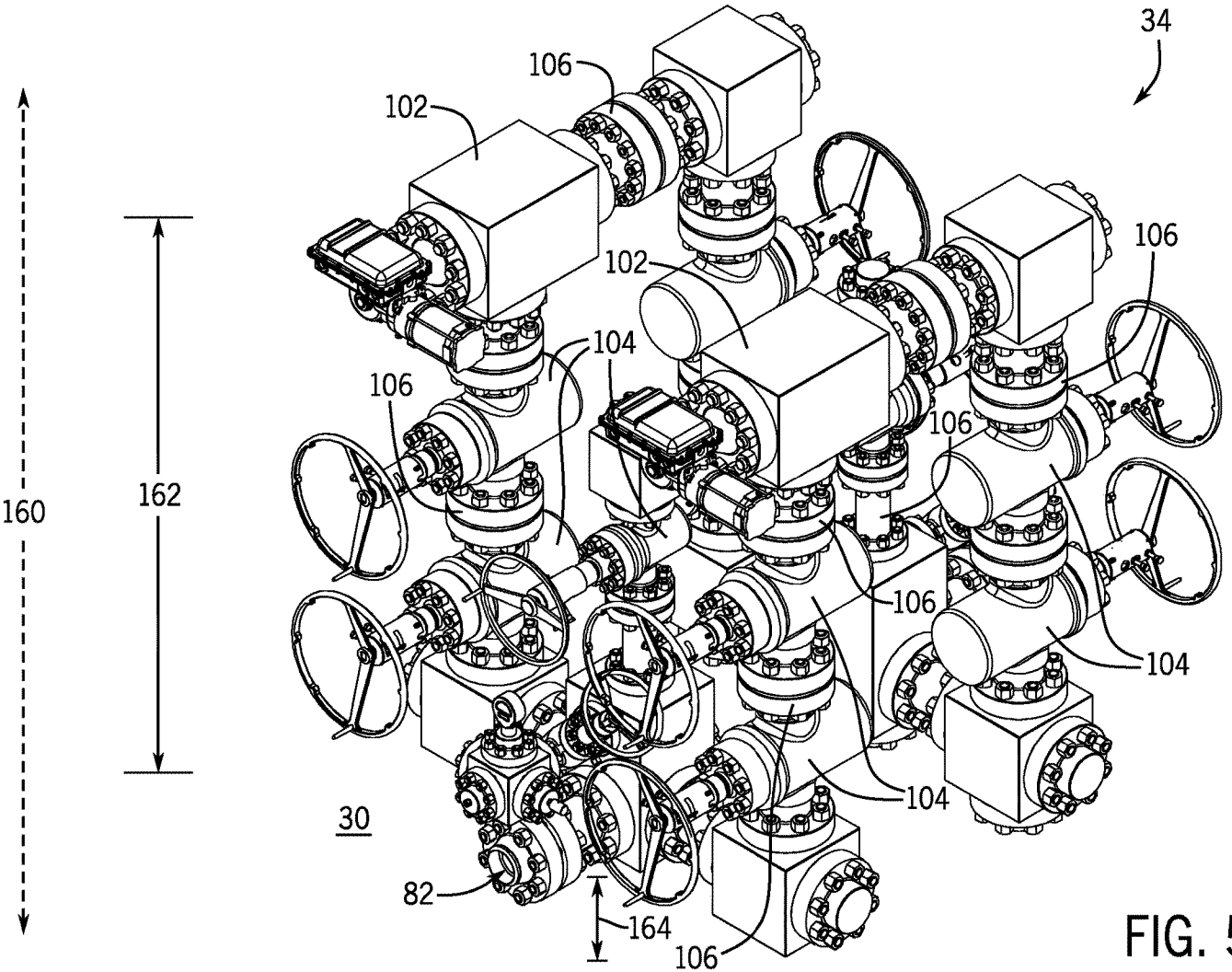
FIG. 5 is a perspective view of the enhanced manifold assembly, in accordance with an aspect of the present disclosure.

FIG. 5 is a perspective view of an embodiment of the manifold assembly 34. The embodiment of the manifold assembly 34 shown in FIG. 6 may be configured to direct the drilling fluid along the first drilling fluid flow path (e.g., as shown by arrows 120 in FIG. 3) and the second drilling fluid flow path (e.g., as shown by arrows 144 in FIG. 4). As shown in the illustrated embodiment of FIG. 5, the choke valve 102 is positioned above the inlet 82 with respect to a vertical axis 160. In other words, a vertical height 162 of the choke valve 102 may be greater than a vertical height 164 of the inlet 82 with respect to the rig 30. Accordingly, one or more of the conduits 106 may extend vertically along the axis 160. Additionally, one or more of the conduits 106 may extend crosswise (e.g., substantially perpendicular to) the axis 160 to direct the drilling fluid along the first drilling fluid flow path and the second drilling fluid flow path. As such, the manifold assembly 34 may be configured to fit within a smaller area because components of the manifold assembly 34 (e.g., the choke valve 102, the valves 104, and/or the conduits 106) are stacked on top of one another along the vertical axis 160. Such a configuration enables the manifold assembly 34 to consume less space on the rig 30.

Figure 6:
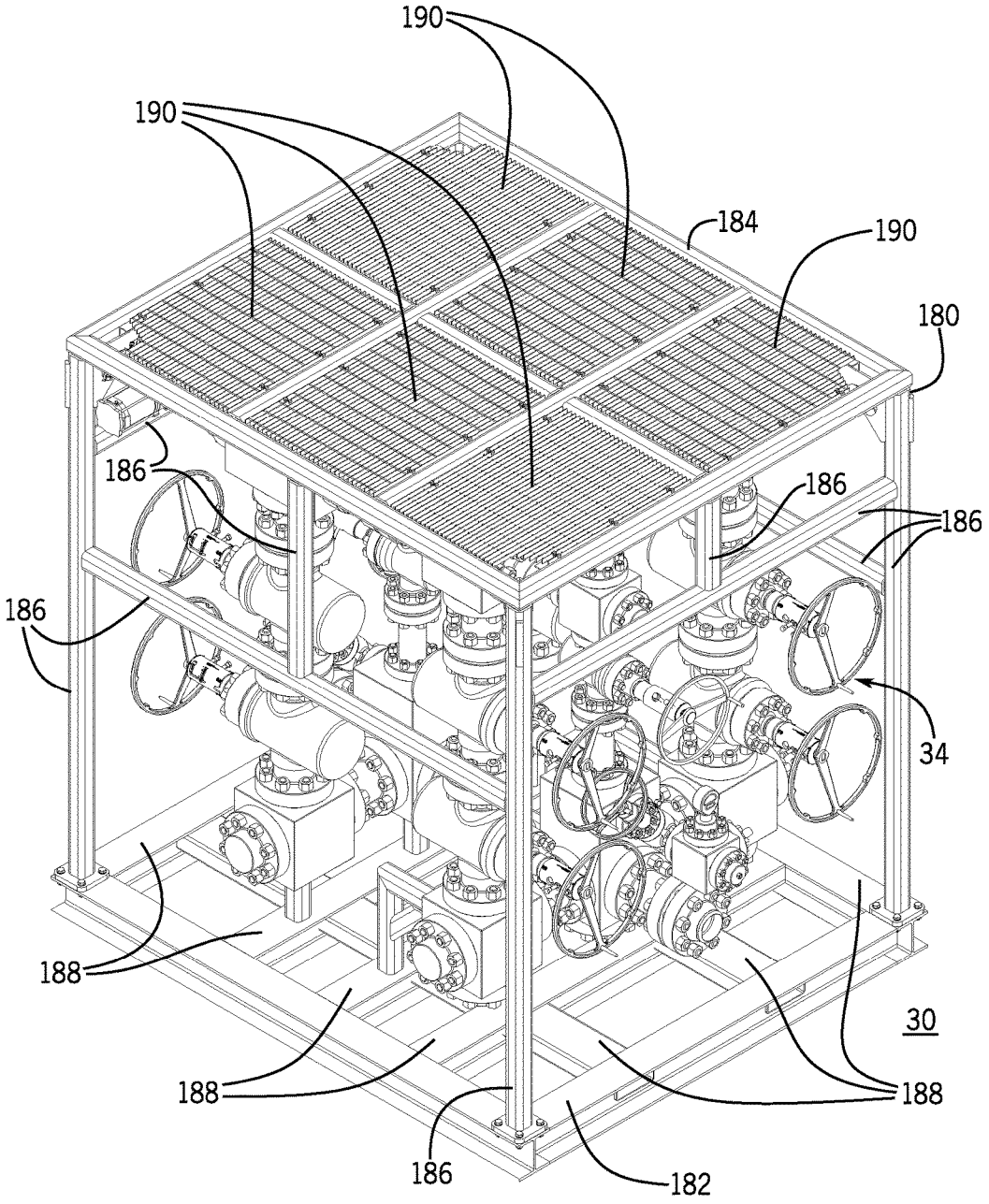
FIG. 6 is a perspective view of the enhanced manifold assembly disposed in a skid for installation, in accordance with an aspect of the present disclosure.

FIG. 6 is a perspective view of the manifold assembly 34 disposed within a skid 180. As shown in the illustrated embodiment, the skid 180 may include a base 182, a top 184 (e.g., a roof or cover), and one or more structural members 186 coupling the base 182 to the top 184. The base 182, the top 184, and/or the structural members 186 may enable the manifold assembly 34 to be coupled to the rig 30 (e.g., secured to the rig), such that the manifold assembly 34 does not move with respect to the rig 30. For example, in some embodiments, the base 182 may include one or more beams 188 that may support the manifold assembly 34 as well as facilitate coupling the skid 180 to the rig 30 (e.g., bolts and/or other coupling components may be utilized to secure the beams 188 of the base 182 to the rig 30). Additionally, in some embodiments, the top 184 may include one or more panels 190 that may be configured to at least partially cover the manifold assembly 34 and/or block light, rain, snow, dirt, contaminants, and/or other materials from contacting at least a portion of the manifold assembly 34. Thus, the skid 180 may both facilitate coupling the manifold assembly 34 to the rig 30 as well as provide some protection to the manifold assembly 34 from various materials that may degrade the manifold assembly 34.

While the presently disclosed embodiments may be susceptible to various modifications and alternative forms, specific embodiments have been shown by way of example in the drawings and have been described in detail herein. However, it should be understood that the present disclosure is not intended to be limited to the particular forms disclosed. Rather, the present disclosure is to cover all modifications, equivalents, and alternatives falling within the spirit and scope of the present disclosure as defined by the following appended claims.

The invention claimed is:

1. A system, comprising:

a manifold assembly configured to direct a flow of drilling fluid, comprising:

a first drilling fluid flow path configured to enable operation of a riser gas handling drilling technique for a mineral extraction system, wherein the first drilling fluid flow path comprises an inlet coupled to the flow of drilling fluid and one or more first outlets that couple to a mud gas separator, a flare, a shaker, or a combination thereof;

a second drilling fluid flow path configured to enable operation of a second drilling technique for the mineral extraction system, different from the riser gas handling drilling technique, wherein the second drilling fluid flow path comprises the inlet coupled to the flow of drilling fluid and one or more second outlets that couple to a flow meter, and wherein the first drilling fluid flow path and the second drilling fluid flow path are different from one another;

a valve configured to control the flow of drilling fluid through the flow meter;

a gas sensor coupled to the manifold assembly and configured to emit a signal indicative of gas, wherein the gas sensor is upstream from the flow meter; and a controller configured to control the valve to alternatingly direct the drilling fluid through the first drilling fluid flow path and the flow meter coupled to the second drilling fluid flow path in response to the signal from the gas sensor.

2. The system of claim 1, wherein the second drilling technique comprises managed pressure drilling.

3. The system of claim 1, wherein a first component of the manifold assembly is stacked on top of a second component of the manifold assembly with respect to a vertical axis.

4. The system of claim 3, wherein the first component and the second component define at least a portion of both the first drilling fluid flow path and the second drilling fluid flow path.

5. The system of claim 1, wherein the inlet is fluidly coupled to a choke valve configured to reduce a pressure of the drilling fluid flowing into the first drilling fluid flow path, the second drilling fluid flow path, or both the first drilling fluid flow path and the second drilling fluid flow path.

6. The system of claim 1, wherein the inlet is fluidly coupled to a bleed line of a wellbore, a primary drilling fluid flow line, and a secondary drilling fluid flow line.

7. The system of claim 6, wherein the inlet is fluidly coupled to a distribution manifold, a filter, or a combination thereof.

8. The system of claim 7, wherein the distribution manifold is configured to adjust a flow rate of the drilling fluid flowing into the filter.

9. The system of claim 8, wherein the filter comprises one or more mesh screens, membranes, or a combination thereof.

10. The system of claim 1, wherein the one or more first outlets are fluidly coupled to the mud gas separator, the flare, the shaker, or the combination thereof, and wherein the one or more second outlets are fluidly coupled to the flow meter.

11. A system, comprising:

a manifold assembly, comprising:

a first drilling fluid flow path configured to enable operation of a riser gas handling drilling technique for a mineral extraction system, wherein the first drilling fluid flow path comprises an inlet coupled to a flow of drilling fluid and one or more first outlets that couple to a mud gas separator, a flare, a shaker, or a combination thereof;

a second drilling fluid flow path configured to enable operation of a managed pressure drilling technique for the mineral extraction system, wherein the second drilling fluid flow path comprises the inlet coupled to the flow of drilling fluid and one or more second outlets that couple to a flow meter, and wherein the first drilling fluid flow path and the second drilling fluid flow path are different from one another;

a first secondary flow path fluidly coupled to the first and second drilling fluid flow paths, wherein the first secondary flow path is downstream of the inlet and upstream from the one or more first outlets and the one or more second outlets; and a second secondary flow path fluidly coupled to the first and second drilling fluid flow paths, wherein the second secondary flow path is downstream of the inlet and upstream from the one or more first outlets and the one or more second outlets;

a third secondary flow path fluidly coupled to the first and second drilling fluid flow paths, wherein the third secondary flow path is downstream of the inlet and upstream from the one or more first outlets and the one or more second outlets;

a sensor downstream from the first secondary flow path, the second secondary flow path, and the third secondary flow path and upstream from the one or more first and second outlets; and wherein the flow meter is downstream from the sensor and configured to receive the flow of drilling fluid flowing through the second drilling fluid flow path.

12. The system of claim 11, wherein a first component of the manifold assembly is stacked on top of a second component of the manifold assembly with respect to a vertical axis.

13. The system of claim 12, wherein the first component and the second component define at least a portion of both the first drilling fluid flow path and the second drilling fluid flow path.

14. The system of claim 11, wherein the inlet is fluidly coupled to a bleed line of a wellbore, a primary drilling fluid flow line, a secondary drilling fluid flow line, or a combination thereof.

15. The system of claim 14, wherein the inlet is fluidly coupled to a distribution manifold, a filter, or a combination thereof.

16. The system of claim 11, wherein the one or more first outlets are fluidly coupled to the mud gas separator, the flare, the shaker, or the combination thereof, and wherein the one or more second outlets are fluidly coupled to the flow meter.

17. A method, comprising:

directing a flow of drilling fluid along a first drilling fluid flow path of a manifold assembly under a first set of drilling parameters, wherein the first drilling fluid flow path comprises an inlet coupled to the flow of drilling fluid and one or more first outlets that couple to a mud gas separator, a flare, a shaker, or a combination thereof;

directing the flow of drilling fluid along a second drilling fluid flow path of the manifold assembly under a second set of drilling parameters, wherein the second drilling fluid flow path comprises the inlet coupled to the flow of drilling fluid and one or more second outlets that couple to a flow meter, and wherein the first drilling fluid flow path and the second drilling fluid flow path are different from one another; and switching from directing the drilling fluid along the second drilling fluid flow path to directing the drilling fluid along the first drilling fluid flow path in response to a gas sensor detecting a first parameter indicative of the first set of drilling parameters, wherein the gas sensor is upstream from the flow meter, wherein switching from directing the drilling fluid along the second drilling fluid flow path to directing the drilling fluid along the first drilling fluid flow path comprises closing a valve fluidly coupled to and upstream from the flow meter.

18. The method of claim 17, wherein the first set of drilling parameters correspond to a riser gas handling drilling technique and the second set of drilling parameters correspond to a managed pressure drilling technique.

19. The method of claim 17, comprising switching from directing the drilling fluid along the first drilling fluid flow path to directing the drilling fluid along the second drilling fluid flow path in response to the gas sensor detecting a second parameter indicative of the second set of drilling parameters.

* * * * *